US006290076B1

(12) United States Patent
Sayers

(10) Patent No.: US 6,290,076 B1
(45) Date of Patent: Sep. 18, 2001

(54) SHIPPING TOWER

(76) Inventor: Thomas W. Sayers, 143 Highcrest, Westfield, NJ (US) 07480

( * ) Notice: Subject to any disclaimer, the term of this patent is extended or adjusted under 35 U.S.C. 154(b) by 0 days.

(21) Appl. No.: 09/680,222

(22) Filed: Oct. 6, 2000

(51) Int. Cl.[7] ..... A47F 5/00
(52) U.S. Cl. ..... 211/126; 211/41.1; 410/32
(58) Field of Search ..... 211/41.1, 126, 211/126.2, 126.15; 206/449; 410/32

(56) References Cited

U.S. PATENT DOCUMENTS

| | | | | |
|---|---|---|---|---|
| 3,126,101 | | 3/1964 | Katterjohn | 211/176 |
| 3,169,640 | | 2/1965 | Favre | 211/126 |
| 3,199,683 | * | 8/1965 | Gwaswich . | |
| 3,963,125 | * | 6/1976 | Baggott | 211/126 |
| 4,300,691 | | 11/1981 | Shemtov | 211/131 |
| 4,351,246 | | 9/1982 | Hutchins, Jr. | 108/156 |
| 4,480,756 | | 11/1984 | Belokin, Jr. | 211/126 |
| 4,531,645 | | 7/1985 | Tisbo et al. | 211/131 |
| 4,848,608 | * | 7/1989 | Anderson | 211/126 |
| 4,890,748 | | 1/1990 | Visser | 211/133 |
| 5,042,651 | | 8/1991 | Davis et al. | 206/45 |
| 5,263,595 | * | 11/1993 | Hilstolsky | 211/126 |
| 5,924,577 | * | 7/1999 | Gessert | 211/41.1 |
| 5,957,309 | | 9/1999 | Hall | 211/126.2 |

* cited by examiner

*Primary Examiner*—Robert W. Gibson, Jr.
(74) *Attorney, Agent, or Firm*—Arnold D. Litt

(57) ABSTRACT

The shipping tower includes at least four uprights defining a rectangular, upwardly extending space, wherein first and second uprights face third and fourth uprights. A plurality of cross members link the plurality of uprights to form a stable upstanding structure. A first plurality of support arms are secured between the first upright and the second upright and a second plurality of support arms are secured between the third upright and the fourth upright. The support arms of the first plurality of support arms are respectively aligned with the support arms of the second plurality of support arms so as to form shelves upon which trays may be positioned for shipment thereof. The four uprights, the plurality of cross members, the first plurality of support arms and the second plurality of support arms are formed from laminated paper. In accordance with a preferred embodiment of the invention, the shipping tower further includes a second upwardly extending space defined by fixed uprights and a central space positioned between the first and second upwardly extending spaces. The central space includes a plurality of floating uprights.

20 Claims, 5 Drawing Sheets

SHIPPING TOWER

BACKGROUND OF THE INVENTION

1. Field of the Invention

The invention relates to a shipping tower. More particularly, the invention relates to shipping towers constructed from laminated paper and which are capable of being readily disassembled and reassembled.

2. Description of the Prior Art

Metals carts have long been used as a means of shipping trays of items, for example, plants, from one location to another. These carts are generally constructed from various metals, for example, galvanized metal or stainless steel, for extended use. The metal carts on casters are moved from one location to another as needed, and are stored on location until such a time that they are required for shipping. If, however, a location requires a metal cart for a shipment, and no metal carts are stored at the location, the location must order additional metal carts and wait for their delivery.

With this in mind, prior metal carts have many shortcomings. They are expensive to manufacture and maintain, they require substantial storage space if one is to maintain a ready supply of metal carts and they may not be readily available when one needs to ship products.

In addition to metal carts, plants are often transported through the use of corrugated cartons. However, such containers are often placed on their sides or upside down during transit, destroying the plants contained with the cartons.

A need, therefore, exists for an improved shipping device or system in the form of the present shipping tower. The shipping tower is inexpensive, easily stored and shipped, and readily available for use at locations where metal carts or corrugated cartons are not normally stored.

SUMMARY OF THE INVENTION

It is, therefore, an object of the present invention to provide a shipping tower. The shipping tower includes at least four uprights defining a rectangular, upwardly extending space, wherein first and second uprights face third and fourth uprights. A plurality of cross members link the plurality of uprights to form a stable upstanding structure. A first plurality of support arms are secured between the first upright and the second upright and a second plurality of support arms are secured between the third upright and the fourth upright. The support arms of the first plurality of support arms are respectively aligned with the support arms of the second plurality of support arms so as to form shelves upon which trays may be positioned for shipment thereof. The four uprights, the plurality of cross members, the first plurality of support arms and the second plurality of support arms are formed from laminated paper.

It is also an object of the present invention to provide a shipping tower wherein staples respectively couple the four uprights to the cross members.

It is another object of the present invention to provide a shipping tower wherein each of the uprights has a U-shaped cross section with a closed end connecting first and second extending ends, and the closed end of the first and second uprights face the closed end of the third and fourth uprights.

It is a further object of the present invention to provide a shipping tower wherein the first plurality of support arms are secured to the closed ends of the first and second uprights and the second plurality of support arms are secured to the closed ends of the third and fourth uprights.

It is also another object of the present invention to provide a shipping tower wherein each of the first plurality of support arms are L-shaped and each of the second plurality of support arms are L-shaped.

It is still another object of the present invention to provide a shipping tower including a self centering central section.

It is still a further object of the present invention to provide a shipping tower wherein an over wrap is applied to the four uprights, the plurality of cross members, the first plurality of support arms and the second plurality of support arms.

It is also a further object of the present invention to provide a shipping tower wherein the plurality of cross members includes four cross members.

It is another object of the present invention to provide a shipping tower wherein the first cross member is coupled to a top end of the first upright and a top end of the third upright, the second cross member is coupled to a bottom end of the first upright and a bottom end of the third upright, the third cross member is coupled to a top end of the second upright and a top end of the fourth upright, the fourth cross member is coupled to a bottom end of the second upright and a bottom end of the fourth upright.

It is also an object of the present invention to provide a shipping tower including a fifth upright, sixth upright, seventh upright, and eighth upright defining a second rectangular, upwardly extending space adjacent the space defined by the first, second, third and fourth upright, wherein fifth and sixth uprights face seventh and eighth uprights.

It is yet a further object of the present invention to provide a shipping tower wherein the first cross member is coupled to top ends of the first, third, fifth and seventh uprights, the second cross member is coupled to bottom ends of the first, third, fifth and seventh uprights, the third cross member is coupled to top ends of the second, fourth, sixth and eighth uprights, the fourth cross member is coupled to bottom ends of the second, fourth, sixth and eighth uprights.

It is also an object of the present invention to provide a shipping tower including a first set of four uprights defining a rectangular, upwardly extending space, wherein first and second uprights face third and fourth uprights, and a second set of four uprights defining a rectangular, upwardly extending space, wherein fifth and sixth uprights face seventh and eighth uprights. The first set of four uprights and a second set of four uprights are spaced apart with a central space therebetween. The shipping tower further includes a plurality of cross members fixedly linking the first set of four uprights and the second set of four uprights to form a stable upstanding structure, wherein a first plurality of support arms are secured between the first upright and the second upright, a second plurality of support arms secured between the third upright and the fourth upright, a third plurality of support arms secured between the fifth upright and the sixth upright and a fourth plurality of support arms secured between the seventh upright and the eighth upright. The shipping tower also includes a plurality of floating uprights with support arms secured thereto positioned within the central space for supporting additional strays.

It is another object of the present invention to provide a shipping tower wherein the floating uprights include a ninth upright, a tenth upright, an eleventh upright and a twelfth upright, the floating uprights being free to move within the central space.

It is a further object of the present invention to provide a shipping tower wherein a plurality of support arms are secured between the ninth and tenth uprights and a plurality of support arms are secured between the eleventh and twelfth support uprights.

It is also another object of the present invention to provide a shipping tower wherein the plurality of support arms secured between the ninth and tenth uprights are aligned with the plurality of support arms secured between the eleventh and twelfth support uprights.

It is still a further object of the present invention to provide a shipping tower wherein the cross members, first set of four uprights and the second set of four uprights retain the floating uprights within the central space.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
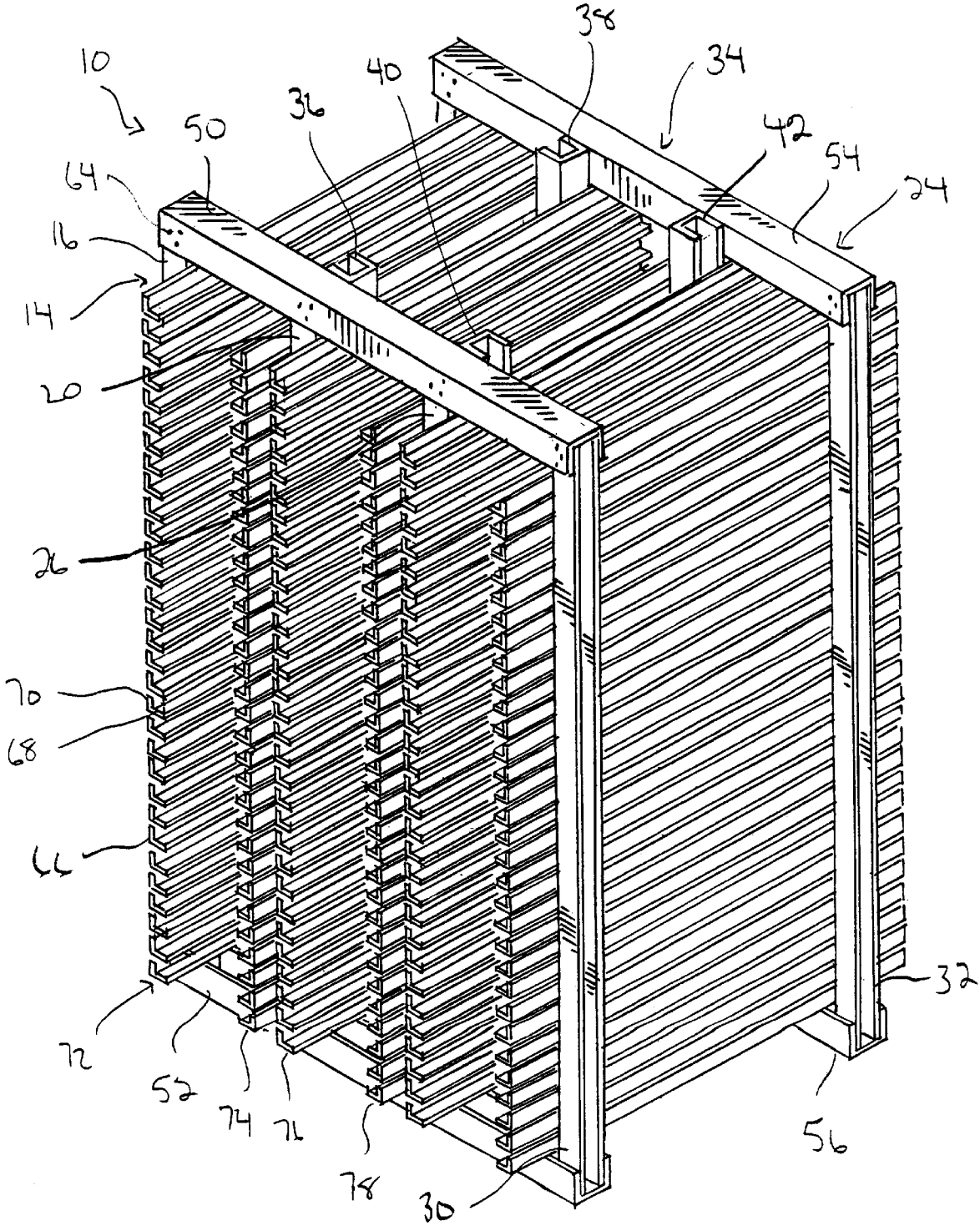
FIG. 1 is a perspective view of the shipping tower in accordance with the present invention.
Figure 3:
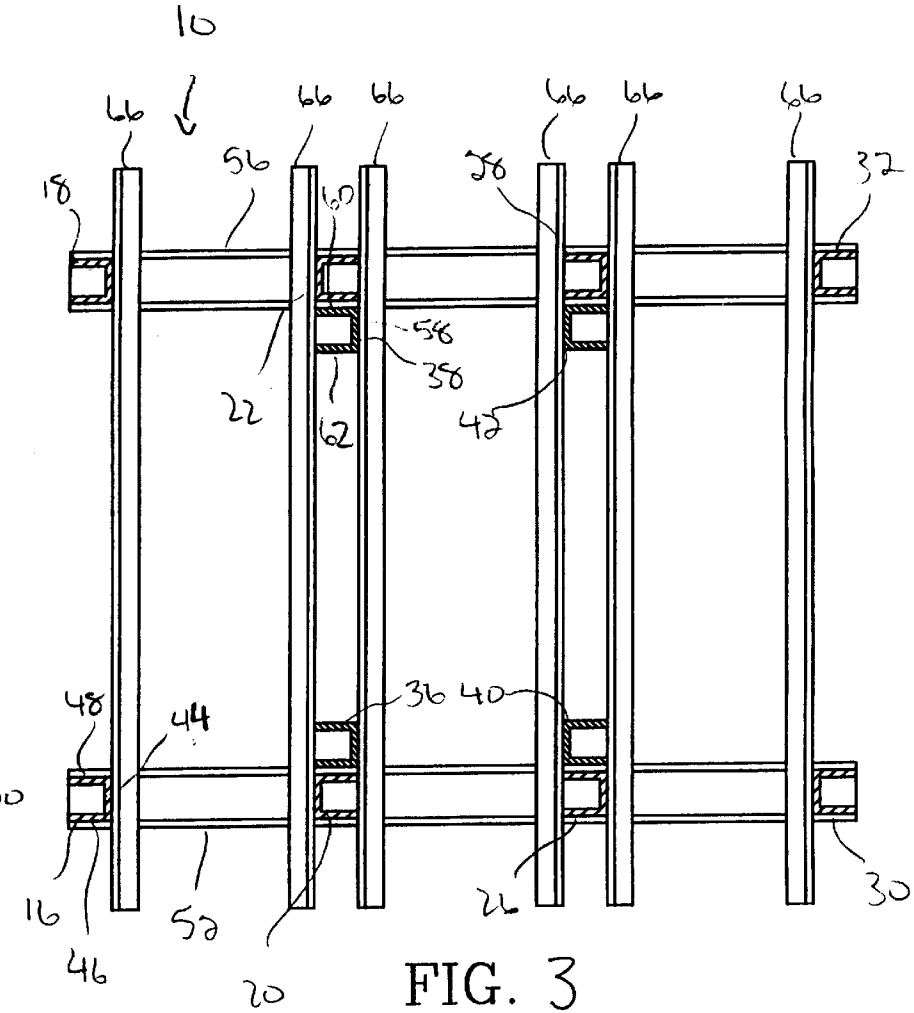
FIG. 3 is a cross sectional view along the line III—III in FIG. 2.
Figure 2:
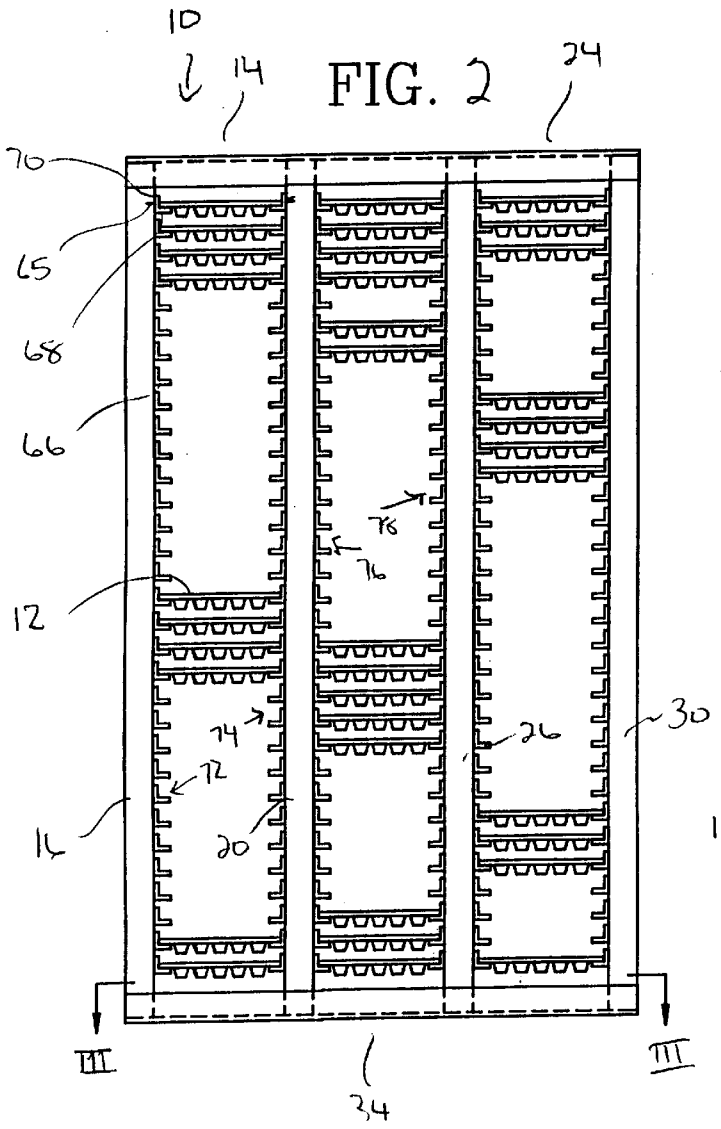
FIG. 2 is a front view of the shipping tower shown in FIG. 1.
Figure 5:
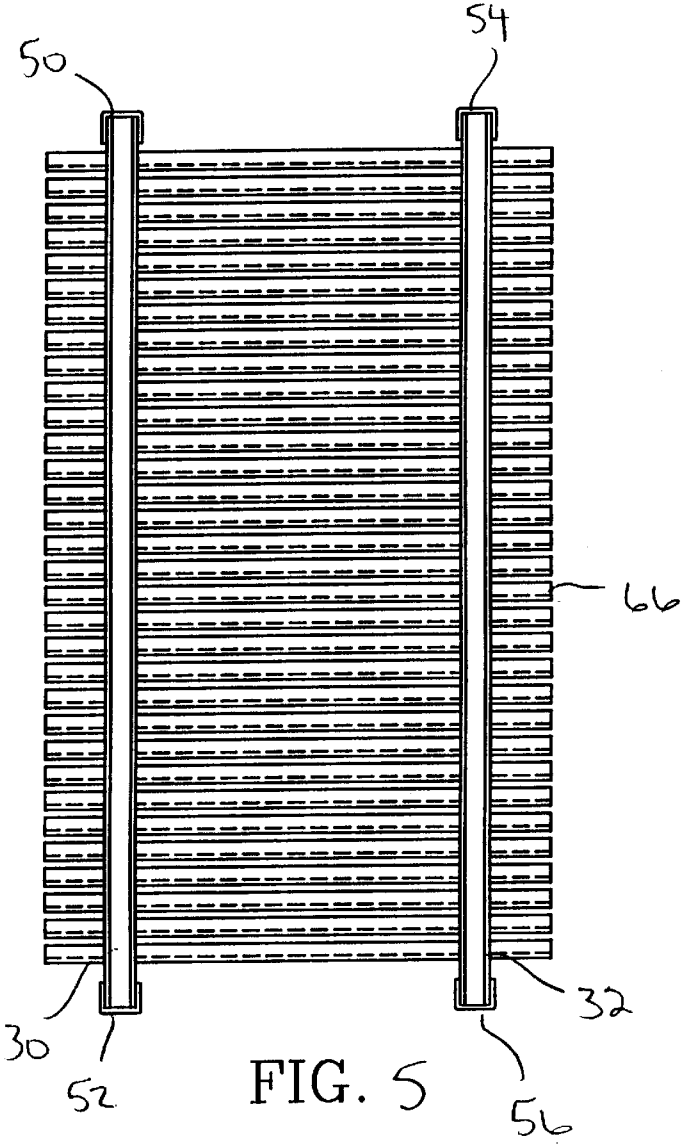
FIG. 5 is a side view of the shipping tower shown in FIG. 1.
Figure 4:
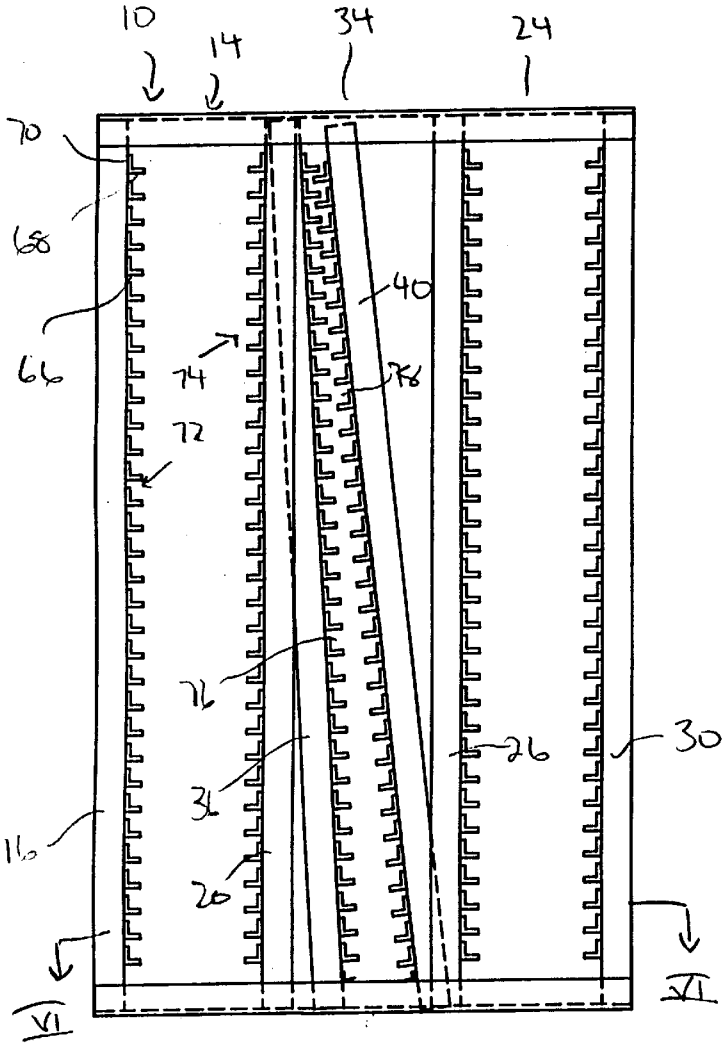
FIG. 4 is a front view of the shipping tower with no trays positioned in the central tower.
Figure 6:
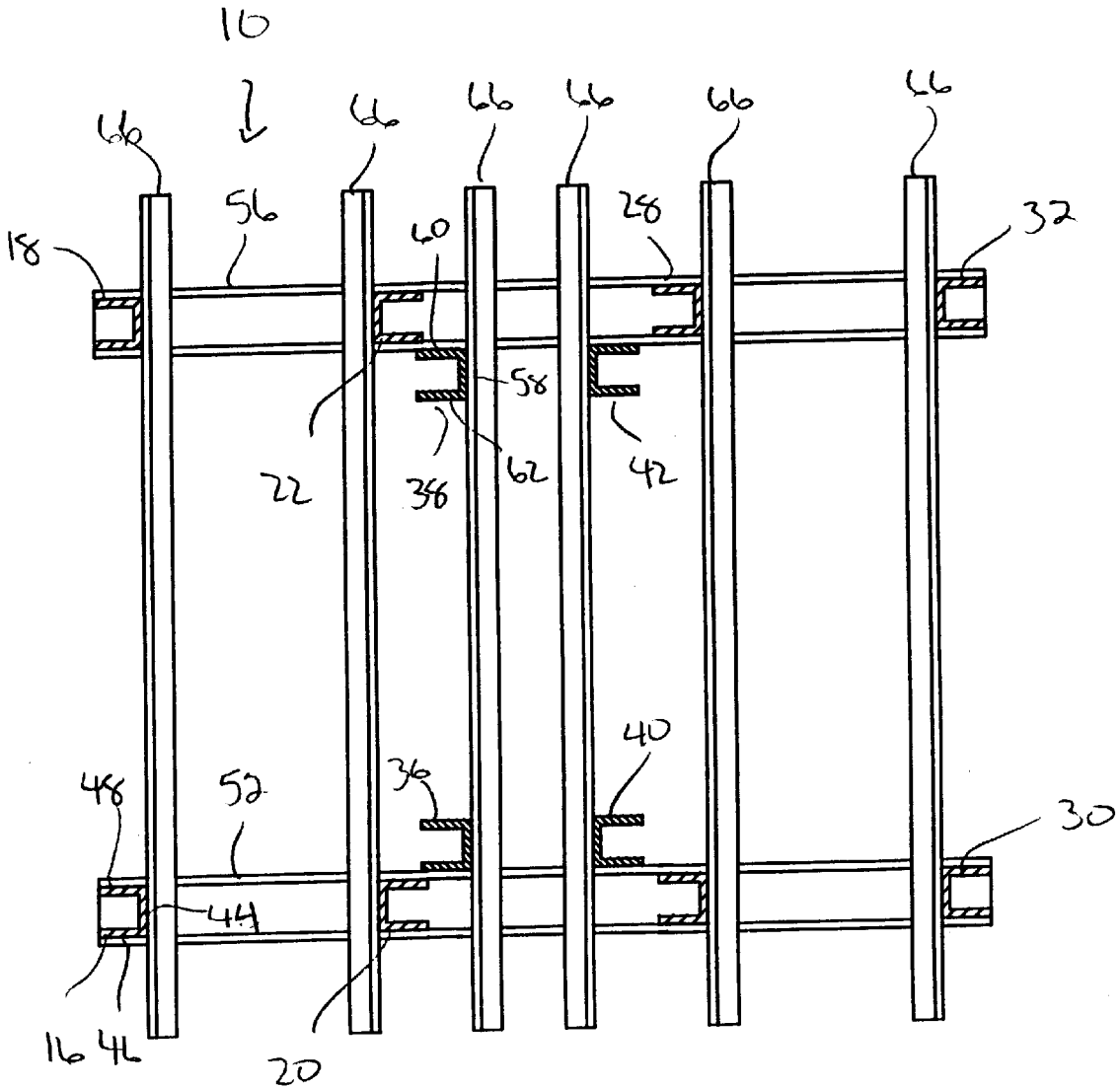
FIG. 6 is a cross sectional view along the line VI—VI in FIG. 4.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 6, a shipping tower 10 is disclosed. The shipping tower 10 is designed for supporting a plurality of removable trays 12 during shipment. In accordance with a preferred embodiment, the trays 12 are plant plug trays commonly used in shipping small plants from location to location. While the disclosed embodiment is designed for use in the shipment of plant plug trays, the shipping towers in accordance with the present invention may be used, and designed for use, with various tray types without departing from the spirit of the present invention.

The shipping tower 10 is designed to provide an alternative to prior metal carts and corrugated cartons. With this in mind, the present shipping tower 10 is designed as a single use assembly which may be readily assembled and/or disassembled at any location. The single use nature of the shipping tower 10, as well as its ability to be readily assembled and disassembled, offers users ease of shipment and storage previously unavailable from prior shipping towers.

The shipping towers in accordance with the present invention are easy to load and provide a high density package that reduces overall shipping and handling costs. The shipping towers may be handled as palletized units, are very rugged, will not tip or tumble like corrugated shipments and may be wrapped or sealed with a stretch wrap covering to add a moisture retention characteristic. The use of shipping towers in accordance with the present invention eliminates lost/damaged carts, enables higher density shipping (that is, ship more per truck), limits the damaging of plants common with the use of corrugated containers and reduces overall shipping cost. In addition, the shipping towers in accordance with a preferred embodiment of the present invention ranges in height between sixty-four inches and ninety-seven inches. However, and as those skilled in the art will readily appreciate, the height may be varied depending upon particular shaping constraints.

In accordance with a preferred embodiment of the present invention, a triple tower 10 is disclosed. The triple tower 10 offers storage space for three parallel columns of trays. While a triple tower is disclosed in accordance with the present invention, single and double towers, as well as larger tower structures, may be manufactured without departing from the spirit of the present invention.

The triple tower 10 includes two sets of four fixed uprights defining rectangular, upwardly extending spaces. Referring to the left tower 14, first and second uprights 16, 18 face third and fourth uprights 20, 22. Similarly, and with reference to the right tower 24, fifth and sixth uprights 26, 28 face seventh and eighth uprights 30, 32.

The central tower 34 is composed of four floating uprights 36, 38, 40, 42. As will be discussed in greater detail below, the floating uprights permit one to construct a shipping tower 10 of a size appropriate for use with a standard 48 inch pallet. Specifically, the floating uprights 36–42 permit the positioning of the floating uprights 36–42 in an overlapping arrangement with the fixed uprights 16–22, 26–32, rather than butting the closed ends 44, 58 of the uprights 16–22, 26–32, 36–42 against each other. The central tower 34 is generally composed of ninth and tenth uprights 36, 38 facing eleventh and twelfth uprights 40, 42.

Each of the various uprights 16–22, 26–32, 36–42 is substantially identical in structure. The use of identical components in the construction of the present shipping tower 10 leads to ease of manufacture, shipping and assembly. This provides end users of the present shipping towers with a vastly improved shipping assembly. With regard to the structure of the uprights 16–22, 26–32, 36–42, they are substantially U-shaped in cross section, and as such include a closed end 44 connecting first and second extending ends 46, 48. In accordance with a preferred embodiment of the present invention, the U-shaped uprights are formed by riveting L-shaped members along overlapping edges to form the U-shaped uprights. As those skilled in the art will appreciate, the U-shaped uprights provide structural stability when the uprights are properly assembled in the manner discussed below.

The plurality of uprights are maintained in a stable configuration through the use of cross members 50, 52, 54, 56. In accordance with a preferred embodiment disclosed in FIGS. 1 to 6, the cross members 50–56 are substantially U-shaped in cross section, and as such include a closed end 58 connecting first and second extending ends 60, 62. As with the uprights 16–22, 26–32, 36–42, the U-shaped cross members 50–56 provide structure stability when properly assembled in the manner discussed below. In fact, the cross members 50–56 are substantially identical to the uprights 16–22, 26–32, 36–42 but are cut to a different length dictated by the dimensions of the shipping tower 10 being constructed.

The cross members 50–56 are secured to the top and bottom ends of the respective fixed uprights 16–22, 26–32 with the first and second extending ends 60, 62 wrapping about the top and bottom ends of the fixed uprights 16–22, 26–32. Specifically, the first cross member 50 is secured across the top ends of the first upright 16, third upright 20, fifth upright 26 and seventh upright 30, and the second cross member 52 is secured across the bottom ends of the first upright 16, third upright 20, fifth upright 26 and seventh upright 30. Similarly, the third cross member 54 is secured across the top ends of the second upright 18, fourth upright 22, sixth upright 28 and eighth upright 32, and the fourth cross member 56 is secured across the bottom ends of the second upright 18, fourth upright 22, sixth upright 28 and eighth upright 32.

The cross members 50–56 are secured to the respective top and bottom ends of the fixed uprights 16–22, 26–32 with fastening members 64 securing adjacent extending ends 46, 48, 60, 62 of the cross members 50–56 and the fixed uprights 16–22, 26–32. Specifically, three staples secure adjacent extending ends 46, 48, 60, 62 of the cross members 50–56 and the fixed uprights 16–22, 26–32. As shown in Figure, and in accordance with a preferred embodiment of the present invention, three staples 64 are applied at each point where extending ends 46, 48, 60, 62 of the fixed uprights 16–22, 26–32 and cross members 50–56 overlap. By securing the cross members 50–56 to the uprights 16–22, 26–32 in this way, a secure structure is created which may be readily shipped while supporting a plurality of trays 12.

As briefly discussed above, and with reference to FIGS. 1, 3, 4 and 6, the floating uprights 36–42 are not fixed to the cross members 50–56. The floating uprights 36–42 defining the central tower 34 are positioned between the left and right towers 14, 24 and the first and third cross members 50, 54. The floating uprights 36–42 are maintained in position as a result of the support arms 66 coupled between adjacent floating uprights 36–42. By fixing the support arms 66 between adjacent floating uprights 36–42, the assembled uprights/support arms are maintained between the cross members 50–56 and fixed towers 14, 24 in a desirable manner. Specifically, and as briefly discussed above, the distance between adjacent floating uprights (for example, ninth upright 36 and tenth upright 38, as well as eleventh upright 40 and twelfth upright 42) is such that they fit between the cross members 50–56. By positioning the floating uprights 36–42 in this way, the floating uprights may be position in an overlapping relationship with the third and fourth fixed uprights 20, 22 of the left tower 14 and the fifth and sixth uprights 26, 28 of the right tower 24. This saves critical space, allowing the shipping tower 10 to be constructed in a way that it may support three columns of the trays on a standard 48 inch pallet.

The trays 12 are supported on the support arms 66 extending between adjacent uprights 16–22, 26–32, 36–42. While the left and right towers 14, 24 are substantially identical, the assembly and attachment of the supports arms 66 will be described with reference to only the left tower 14. The support arms 66 are L-shaped members having a first arm 68 of a size, length and strength sufficient to support a tray 12 positioned thereon and a second arm 70 which is coupled to the closed end 44 of the respective uprights. As with the coupling of the cross members to the uprights, the second arms 70 of the support arms 66 are coupled to the closed ends 44 of the uprights 16–22 with fastening members 65. In accordance with a preferred embodiment of the present invention, the fastening members 65 are rivets applied to pass through both the second arms 70 of the support arms 66 and the closed ends 44 of the uprights 16–22.

Specifically, a first plurality of support arms 72 are secured between the first upright 16 and the second upright 18 and a second plurality of support arms 74 are secured between the third upright 20 and the fourth upright 22. The support arms of the first plurality of support arms 72 are respectively aligned with the support arms of the second plurality of support arms 74 so as to form shelves upon which the trays 12 may be positioned for shipment thereof.

The attachment of the support arms 66 to the floating uprights 36–42 as discussed above is specifically achieved by securing a first plurality of support arms 76 between the ninth upright 36 and the tenth upright 38 and securing a second plurality of support arms 78 between the eleventh upright 40 and the twelfth upright 42. As with the left and right towers 14, 24, the support arms of the first plurality of support arms 76 are respectively aligned with the support arms of the second plurality of support arms 78 so as to form shelves upon which trays 12 may be positioned for shipment thereof. In addition, and when the central tower 34 is unloaded, the support arms 66 located at the bottom of the floating uprights 36–42 function to provide support as they sit upon the second and fourth cross members 52, 56 secured to the bottom of the present shipping tower 10 when the central tower 34 is properly assembled and loaded with trays (see FIGS. 4 and 6). When the central tower 34 is loaded, the bottom ends of the floating uprights 36–42 are supported by either the floor or pallet upon which the shipping tower 10 is placed (see FIG. 1, 2 and 3).

In use, the left and rights towers 14, 24 are always ready to receive trays 12. When it is desired to place trays 12 within the central tower 34, the ninth and tenth uprights 36, 38 with the first plurality of supports arms 76 secured therebetween are pushed to a generally upright position adjacent, and slightly overlapping, the left tower 14 and the eleventh and twelfth uprights 40, 42 with the second plurality of support arms 78 are pushed to a generally upright position adjacent, and slightly overlapping, the right tower 24 (see FIG. 3). The floating uprights 36–42 are then ready for receipt of the trays 12. As the trays 12 are mounted therebetween the uprights 36–42 are held in position, and the structure is stabilized.

As mentioned above, the present shipping tower is designed as a single use assembly which may be easily shipped to a site unassembled, assembled on sight, loaded, shipped to another site, disassembled and discarded. In accordance with a preferred embodiment of the present invention, the shipping tower may be shipped to a desired site with the upright/support arms preassembled, but disconnected from the cross members. As such, once an individual is ready to use the shipping tower, the cross members need only be attached to the uprights in a desired manner.

Figure 7:
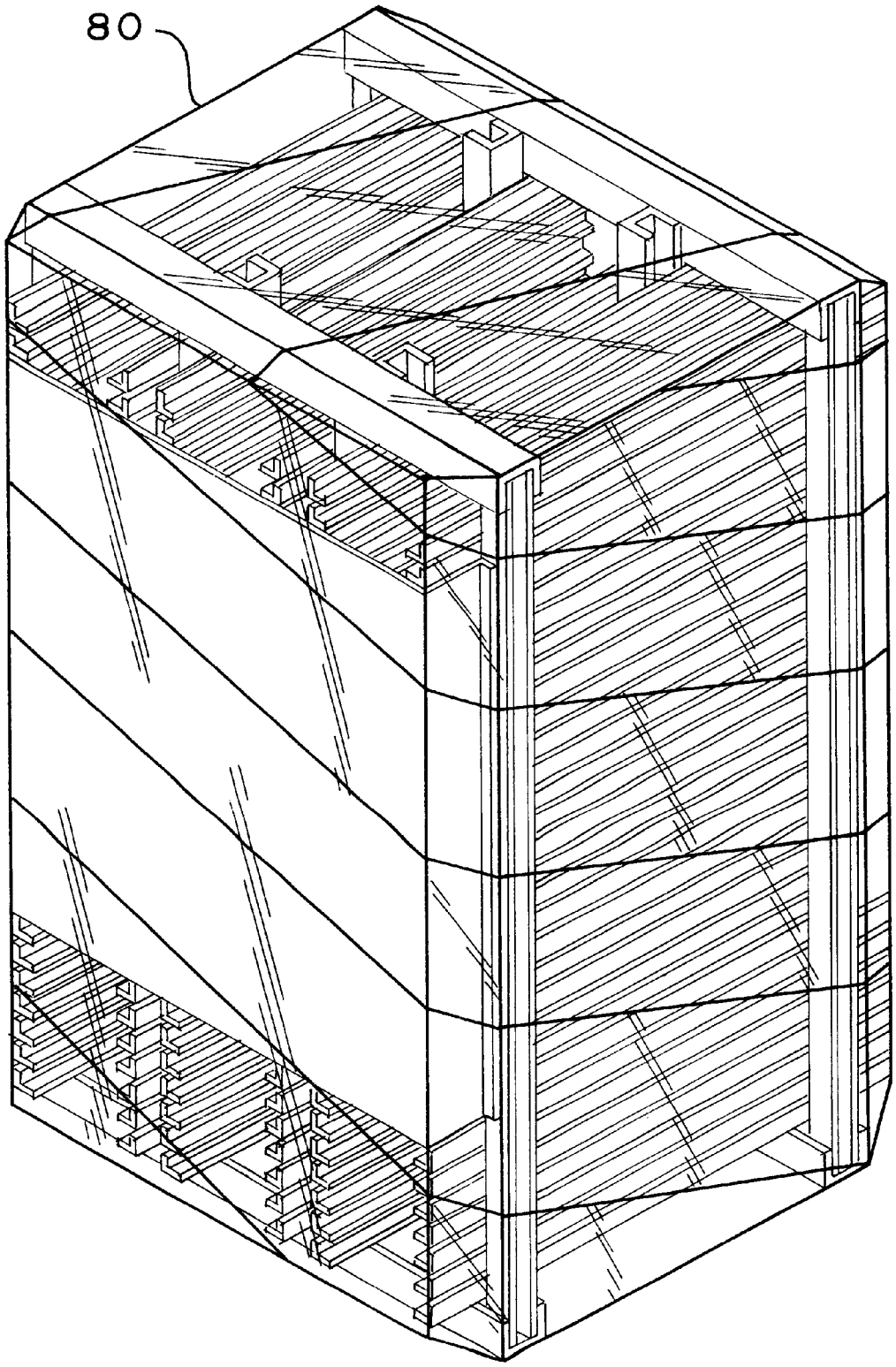
FIG. 7 is a perspective view of the shipping tower appropriately over-wrapped.

With this in mind, the uprights, cross members and support arms are formed of laminated paper. The laminated paper is over-wrapped (80, as shown in FIG. 7) to provide additional protection from water and other environmental elements which might negatively affect the structural stability of the shipping tower. For example, the laminated paper may be wrapped in with film, paper, film coated paper, or a waterproof liquid coating. For example, Mylar or varnish may be applied to the laminated paper to protect the same from environmental conditions. While the present invention is adapted for single use applications, the stability of the present shipping tower allows for multiple uses when such use is desired.

In summary, the present shipping tower offers users a convenient assembly which may be readily assembled and shipped. The shipping tower is further constructed from recycled laminated paper and is, therefore, environmentally friendly. The shipping tower is further constructed for use with traditional fork lifts and pallet trucks. In fact, the tower itself may be constructed on top of or attached to a standard pallet, and does not rely upon wheel or caster systems commonly found in prior art devices.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A shipping tower, comprising:

at least four uprights defining a rectangular, upwardly extending space, wherein first and second uprights face third and fourth uprights;

a plurality of cross members linking the plurality of uprights to form a stable upstanding structure;

a first plurality of support arms secured between the first upright and the second upright and a second plurality of support arms secured between the third upright and the fourth upright, the support arms of the first plurality of support arms being respectively aligned with the support arms of the second plurality of support arms so as to form shelves upon which trays may be positioned for shipment thereof;

and wherein the four uprights, the plurality of cross members, the first plurality of support arms and the second plurality of support arms are formed from laminated paper.

2. The shipping tower according to claim 1, wherein staples respectively couple the four uprights to the cross members.

3. The shipping tower according to claim 1, wherein each of the uprights has a U-shaped cross section with a closed end connecting first and second extending ends, and the closed end of the first and second uprights face the closed end of the third and fourth uprights.

4. The shipping tower according to claim 3, wherein the first plurality of support arms are secured to the closed ends of the first and second uprights and the second plurality of support arms are secured to the closed ends of the third and fourth uprights.

5. The shipping tower according to claim 1, wherein each of the first plurality of support arms are L-shaped and each of the second plurality of support arms are L-shaped.

6. The shipping tower according to claim 1, further including a self centering central section.

7. The shipping tower according to claim 1, wherein an over wrap is applied to the four uprights, the plurality of cross members, the first plurality of support arms and the second plurality of support arms.

8. The shipping tower according to claim 1, wherein the plurality of cross members includes four cross members.

9. The shipping tower according to claim 1, wherein the first cross member is coupled to a top end of the first upright and a top end of the third upright, the second cross member is coupled to a bottom end of the first upright and a bottom end of the third upright, the third is coupled to a top end of the second upright and a top end of the fourth upright, the fourth cross member is coupled to a bottom end of the second upright and a bottom end of the fourth upright.

10. The shipping tower according to claim 1, further including a fifth upright, sixth upright, seventh upright, and eighth upright defining a second rectangular, upwardly extending space adjacent the space defined by the first, second, third and fourth upright, wherein fifth and sixth uprights face seventh and eighth uprights.

11. The shipping tower according to claim 10, wherein the plurality of cross members includes four cross members.

12. The shipping tower according to claim 11, wherein the first cross member is coupled to top ends of the first, third, fifth and seventh uprights, the second cross member is coupled, to bottom ends of the first, third, fifth and seventh uprights, the third cross member is coupled to top ends of the second, fourth, sixth and eighth uprights, the fourth cross member is coupled to bottom ends of the second, fourth, sixth and eighth uprights.

13. A shipping tower, comprising:

a first set of four uprights defining a rectangular, upwardly extending space, wherein first and second uprights face third and fourth uprights;

a second set of four uprights defining a rectangular, upwardly extending space, wherein fifth and sixth uprights face seventh and eighth uprights;

the first set of four uprights and the second set of four uprights being spaced apart with a central space therebetween;

a plurality of cross members fixedly linking the first set of four uprights and the second set of four uprights to form a stable upstanding structure;

a first plurality of support arms secured between the first upright and the second upright, a second plurality of support arms secured between the third upright and the fourth upright, a third plurality of support arms secured between the fifth upright and the sixth upright and a fourth plurality of support arms secured between the seventh upright and the eighth upright;

the support arms of the first plurality of support arms being respectively aligned with the support arms of the second plurality of support arms so as to form shelves upon which trays may be positioned for shipment thereof and the support arms of the third plurality of support arms being respectively aligned with the support arms of the fourth plurality of support arms so as to form shelves upon which trays may be positioned for shipment thereof;

and a plurality of floating uprights with support arms secured thereto positioned within the central space for supporting additional trays.

14. The shipping tower according to claim 13, wherein the floating uprights include a ninth upright, a tenth upright, an eleventh upright and a twelfth upright, the floating uprights being free to move within the central space.

15. The shipping tower according to claim 14, wherein a plurality of support arms are secured between the ninth and tenth uprights and a plurality of support arms are secured between the eleventh and twelfth support uprights.

16. The shipping tower according to claim 15, wherein the plurality of support arms secured between the ninth and tenth uprights are aligned with the plurality of support arms secured between the eleventh and twelfth support uprights.

17. The shipping tower according to claim 16, wherein the cross members, first set of four uprights and the second set of four uprights retain the floating uprights within the central space.

18. The shipping tower according to claim 13, wherein the cross members, first set of four uprights and the second set of four uprights retain the floating uprights within the central space.

19. The shipping tower according to claim 13, wherein the plurality of cross members includes four cross members.

20. The shipping tower according to claim 13, wherein the uprights, the plurality of cross members, and the support arms are formed from laminated paper.

* * * * *

UNITED STATES PATENT AND TRADEMARK OFFICE

CERTIFICATE OF CORRECTION

PATENT NO. : 6,290,076 B1
DATED : September 18, 2001
INVENTOR(S) : Thomas W. Sayers It is certified that error appears in the above-identified patent and that said Letters Patent is hereby corrected as shown below:

Title page,
Item [76], the Inventor's address should read as follows:
-- 143 Highcrest, West Milford, NJ (US) 07480. --

Signed and Sealed this

Thirtieth Day of April, 2002

*Attest:*

*Attesting Officer*

JAMES E. ROGAN
*Director of the United States Patent and Trademark Office*